US006042432A

United States Patent [19]

Hashizawa et al.

[11] Patent Number: 6,042,432

[45] Date of Patent: Mar. 28, 2000

[54] TERMINAL FOR CHARGING WITH LARGE CURRENT

[75] Inventors: Shigemi Hashizawa; Takayoshi Endo, both of Shizuoka, Japan

[73] Assignee: Yazaki Corporation, Tokyo, Japan

[21] Appl. No.: 09/131,342

[22] Filed: Aug. 7, 1998

[30] Foreign Application Priority Data

Aug. 11, 1997 [JP] Japan ..... 9-216625

[51] Int. Cl.[7] ..... H01R 13/187

[52] U.S. Cl. ..... 439/843

[58] Field of Search ..... 439/843, 839, 439/844–847

[56] References Cited

U.S. PATENT DOCUMENTS

| | | | |
|---|---|---|---|
| 5,474,479 | 12/1995 | Bennett et al. | 439/843 |
| 5,486,123 | 1/1996 | Miyazaki | 439/843 |
| 5,667,413 | 9/1997 | Trafton | 439/843 |
| 5,730,628 | 3/1998 | Hawkins | 439/843 |

*Primary Examiner*—Michael L. Gellner
*Assistant Examiner*—Briggitte Hammond
*Attorney, Agent, or Firm*—Armstrong, Westerman, Hattori, McLeland and Naughton

[57] ABSTRACT

A terminal for charging with large current, used for charge of an electric vehicle for example, is provided, wherein unequal deformation of leaf spring pieces acting as contacts on a female terminal side is prevented for attaining sure electrical contact between a male terminal and a female terminal. The terminal includes: a female terminal having a terminal accommodating chamber with an inlet portion having a larger diameter formed at an inlet thereof for accommodating a rod-like male terminal; a contact spring member with a lot of arced leaf spring pieces integrally linked at one side to form a substantially cylindrical shape and a fixing rib projecting in a radial direction to abut on an inlet wall portion of the inlet portion; and a cap having a terminal insertion hole to put the male terminal therethrough and attached to the inlet portion to hold the fixing rib for fixing the contact spring member in the terminal accommodating chamber. Thus, each of free ends of the leaf spring pieces is capable of freely sliding on a surface of the terminal accommodating chamber in the axial direction upon insertion or pulling-out of the male terminal so that each of the leaf spring pieces surely gets in contact with an outer surface of the male terminal for attaining sure electrical contact between the male and female terminals.

11 Claims, 8 Drawing Sheets

300

TERMINAL FOR CHARGING WITH LARGE CURRENT

BACKGROUND OF THE INVENTION

1. Field of the Invention

The present invention generally relates to a terminal for charging with large current, used for charge of an electric vehicle for example, and more particularly to a terminal for charging with large current wherein unequal deformation of leaf spring pieces acting as contacts on a female terminal side is prevented, thereby improving electrical contact between a female terminal and a male terminal.

2. Related Art

FIGS. 6, 7, 8A, and 8B show a prior art terminal for charging with large current used for charge of an electric vehicle.

Referring to FIG. 6, a feeding side connector 1 is connected to feeding equipment (not shown).

The feeding side connector 1 is provided with a couple of divided casings 1*a*, 1*b*, and a female connector main body 10 capable of sliding back and forth by operation of a lever 13 is accommodated in its front end portion.

Male terminal accommodating portions 11,11 are provided on both sides of the female connector main body 10, and, as shown in FIG. 7, rod-like male terminals 12 are accommodated in the respective male terminal accommodating portions 11,11.

Referring to FIG. 6 again, a fed side connector 2 relative to the feeding side connector 1 has a shell 2*a* to receive a front end portion of the feeding side connector 1. The shell 2*a* is bolted at a flange 2*b* to an electric vehicle body (not shown), and a male connector main body 20 relative to the female connector main body 10 is set in the shell 2*a*.

A female terminal accommodating portion 21 of a cylindrical shape to be inserted into the male terminal accommodating portion 11 is provided on the male connector main body 20 and, as shown in FIG. 7, the male terminal 12 and a prior art female terminal 220 are accommodated in the female terminal accommodating portion 21.

The female terminal 220 has a terminal accommodating chamber 220*a* and a large diameter portion 220*b* in which the male terminal 12 is inserted, and a contact spring member 300 acting as an electric contact is fit in the large diameter portion 220*b*.

As shown in FIG. 8A, 8B, the contact spring member 300 consists of a lot of arced leaf spring pieces 310 whose both ends are linked with respective connecting portion 320,320, and has a substantially cylindrical shape corresponding to an outer diameter of the male terminal 12 and to an inner diameter of the large diameter portion 220*b* of the female terminal 220.

With respect to the above prior art terminal, however, the leaf spring pieces 310 of the contact spring member 300 are apt to deform unequally in a state of one side of the contact spring member 300 abutting on an end wall of the large diameter portion 220*b* when the male terminal 12 is inserted into the female terminal 220 since curvature of each of the leaf spring pieces 310 is not necessarily the same due to such as a manufacturing error and since each side of the contact spring member 300 is of linked-structure, thereby causing poor electrical contact between the male and female terminals 12,220.

SUMMARY OF THE INVENTION

In view of the foregoing, an object of the present invention is to provide a terminal for charging with large current wherein unequal deformation of leaf spring pieces acting as contacts on a female terminal side is prevented, thereby improving electrical contact between a female terminal and a male terminal.

In order to achieve the above object as a first aspect of the present invention, the present invention provides a terminal for charging with large current including: a female terminal having a terminal accommodating chamber to accommodate a rod-like male terminal, the terminal accommodating chamber having an inlet portion with a larger diameter formed at an inlet thereof; a contact spring member consisting of a lot of arced leaf spring pieces integrally linked at one side thereby to form a substantially cylindrical shape corresponding to an outer diameter of the male terminal and to an inner diameter of the terminal accommodating chamber of the female terminal, and having a fixing rib projecting in a radial direction from the one side integrally linked so as to abut the fixing rib on an inlet wall portion provided on an inner end of the inlet portion of the female terminal; and a cap having a terminal insertion hole to put the male terminal therethrough and attached to the inlet portion of the female terminal to hold the fixing rib of the contact spring member so as to fix the contact spring member in the terminal accommodating chamber of the female terminal; wherein each of ends on the other side, being not integrally linked, of the leaf spring pieces of the contact spring member is capable of freely sliding on a surface of the terminal accommodating chamber in an axial direction thereof upon insertion or pulling-out of the male terminal so that each of the leaf spring pieces surely gets in contact with an outer surface of the male terminal, thereby attaining sure electrical contact between the male terminal and the female terminal.

In the above structure, the fixing rib of the contact spring member is, preferably, annularly formed correspondingly to whole of the inlet wall portion of the female terminal or may be formed in a shape of piece partially corresponding to the inlet wall portion.

Further, as a second aspect of the present invention, the present invention provides a terminal for charging with large current including: a female terminal having a terminal accommodating chamber to accommodate a rod-like male terminal, the terminal accommodating chamber having an engaging recess formed near an inlet thereof; and a contact spring member consisting of a lot of arced leaf spring pieces integrally linked at one side thereby to form a substantially cylindrical shape corresponding to an outer diameter of the male terminal and to an inner diameter of the terminal accommodating chamber of the female terminal, and having a plurality of engaging pieces on the one side integrally linked so as to engage the engaging recess on the female terminal; wherein each of ends on the other side, being not integrally linked, of the leaf spring pieces of the contact spring member is capable of freely sliding on a surface of the terminal accommodating chamber in an axial direction thereof upon insertion or pulling-out of the male terminal so that each of the leaf spring pieces surely gets in contact with an outer surface of the male terminal, thereby attaining sure electrical contact between the male terminal and the female terminal.

Preferably, the above engaging pieces of the contact spring member incline oppositely to each other in an insertion or pulling-out direction of the male terminal.

Still further, as a third aspect of the present invention, the present invention provides a terminal for charging with large current further including: a holder for limiting circumferential movement of each of free ends of the leaf spring pieces of the contact spring member.

According to the terminal of the present invention as described hereinabove, electrical contact between male and female terminals can be improve by surely preventing unequal deformation of leaf spring pieces acting as contacts on the female terminal side.

BRIEF DESCRIPTION OF THE DRAWING FIGURES

DETAILED DESCRIPTION OF THE PREFERRED EMBODIMENTS

Embodiments of the present invention will now be described in further detail with reference to the accompanying drawings.

FIG. 1 shows a first embodiment of a terminal for charging with large current in accordance with the present invention.

Figure 1A:
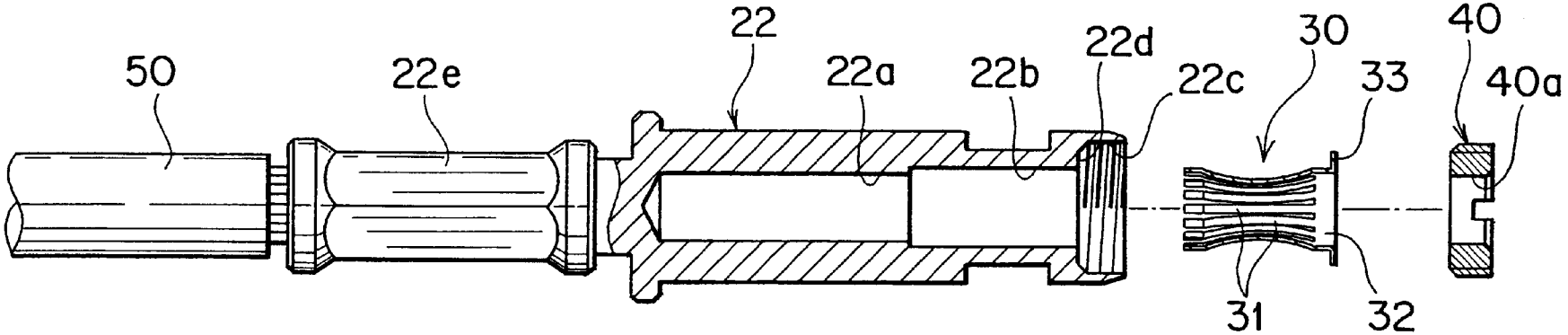
FIG. 1A is a partially longitudinal-sectional view showing a first embodiment of a terminal for charging with large current in accordance with the present invention.
Figure 6:
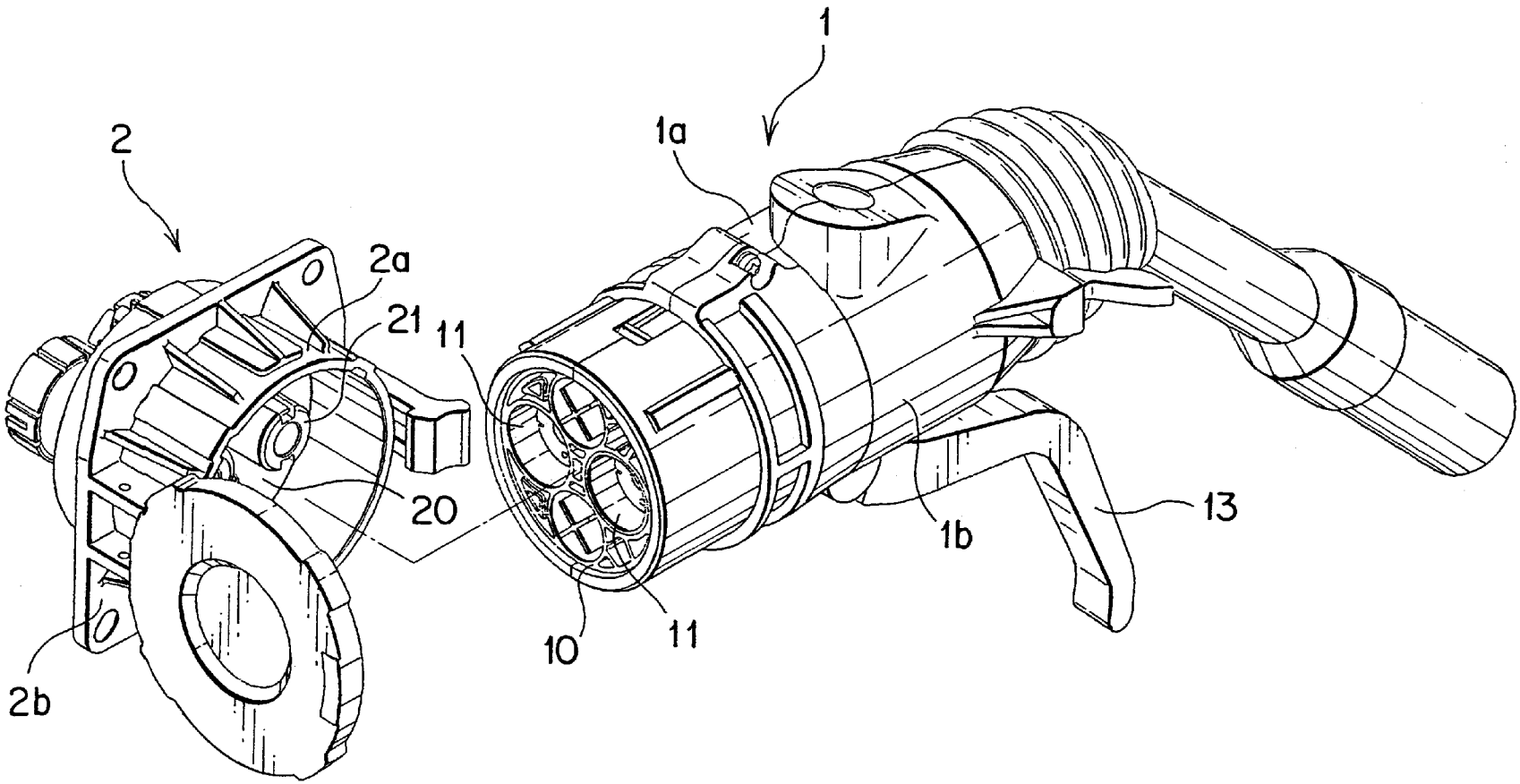
FIG. 6 PRIOR ART
FIG. 6 is a perspective view showing a feeding side connector and a fed side connector equipping a prior art terminal for charging with large current.

Referring to FIG. 1A, a female terminal 22 is provide in a female terminal accommodating portion 21 (FIG. 6) of a fed side connector 2 like prior art ones.

A terminal accommodating chamber 22*a* having almost the same diameter as a male terminal 12 (FIG. 6) is formed in the center of the female terminal 22, and a large diameter portion 22*b* is formed on an opening side of the terminal accommodating chamber 22*a* for accommodating a contact spring member 30. And, an inlet portion 22*c* having larger diameter than that of the large diameter portion 22*b* is formed at an inlet of the terminal accommodating chamber 22.

A screwing portion 22*e* is provided on the rear end side of the female terminal 22 and an electric wire 50 is pressure-welded to the portion 22*e*.

The contact spring member 30 is accommodated in the large diameter portion 22*b* of the female terminal 22 and acts as an electric contact with the male terminal 12.

Figure 1B:
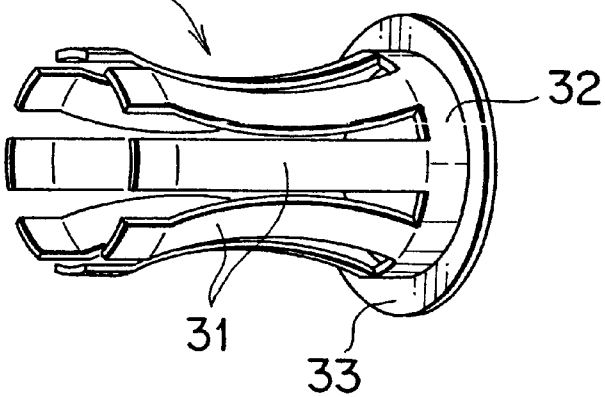
FIG. 1B is a perspective view of the contact spring member of FIG. 1A.

As shown in FIG. 1B, the contact spring member 30 consists of a lot of arced leaf spring pieces 31 whose one ends are linked with a connecting portion 32, and has a substantially cylindrical shape corresponding to an outer diameter of the male terminal 12 and to an inner diameter of the large diameter portion 22*b* of the female terminal 22.

Figure 2A:
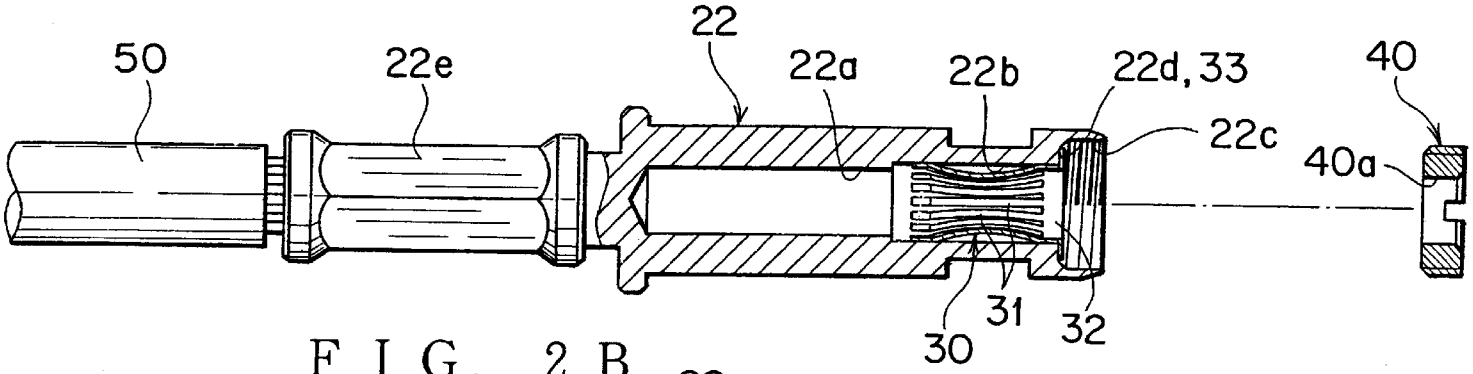
FIG. 2A and 2B are also partially longitudinal-sectional views showing a state of the contact spring member fit into the female terminal.

A fixing rib 33 projecting in a radial direction is formed on the connecting portion 32. The fixing rib 33 is annularly formed correspondingly to an inlet wall portion 22*d* of the female terminal 22 and, as shown in FIG. 2A, abuts on the inlet wall portion 22*d* when the contact spring member 30 is accommodated in the large diameter portion 22*b* of the female terminal 22.

The other end of each of the leaf spring pieces 31 is of free end. And, the large diameter portion 22*b* of the female terminal 22 is formed longer than the leaf spring pieces 31 so as to permit the leaf spring pieces 31 to axially extend freely when the male terminal 12 is inserted into the contact spring member 30.

Referring to FIG. 1A again, a cap 40 with male screw is provided to fix the contact spring member 30 accommodated in the large diameter portion 22*b* by screwing the cap 40 into the inlet portion 22*c* with female screw.

Figure 2B:
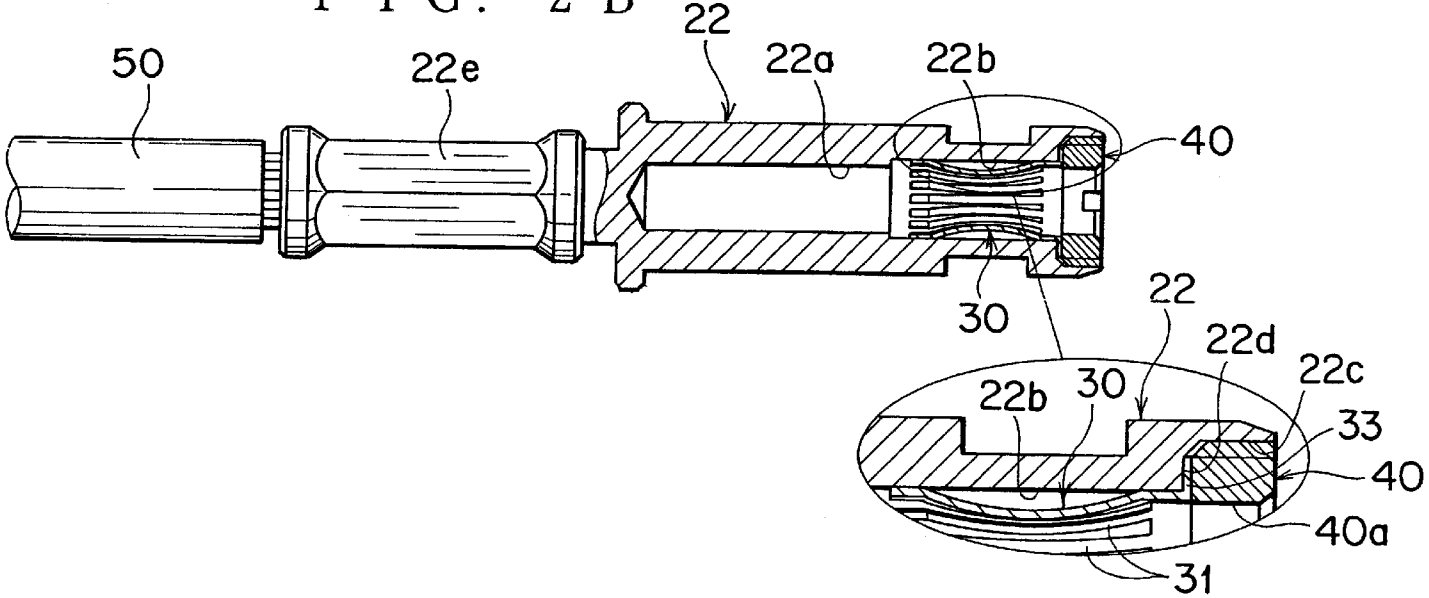

As shown in FIG. 2B, the fixing rib 33 of the contact spring member 30 is held between the cap 40 and the inlet wall portion 22*d* so as to fix the contact spring member 30 in the large diameter portion 22*b*.

And, a terminal insertion hole 40*a* is formed on the cap 40 to put the male terminal 12 therethrough.

As described hereinabove, according to the first embodiment of the present invention, since one end provided with the fixing rib 33 of the contact spring member 30 is fixed to an inlet of the large diameter portion 22*b* of the female terminal 22, when the male terminal 12 is inserted into the female terminal 22, the leaf spring pieces 31 are permitted to uniformly deform without abutting their free ends on the inner end of the large diameter portion 22*b* of the female terminal 22.

And, each of the free ends of the leaf spring pieces 31 is capable of independently deform when the male terminal 12 is inserted into the female terminal 22.

Thus, this structure can improve electrical contact between the female terminal 22 and the male terminal 12 by surely preventing unequal deformation of the leaf spring pieces 31.

Further, since the fixing rib 33 of the contact spring member 30 is annularly formed correspondingly to the inlet wall portion 22*d* of the female terminal 22, the contact spring member 30 can be fixed stable in the large diameter portion 22*b*.

Figure 3A:
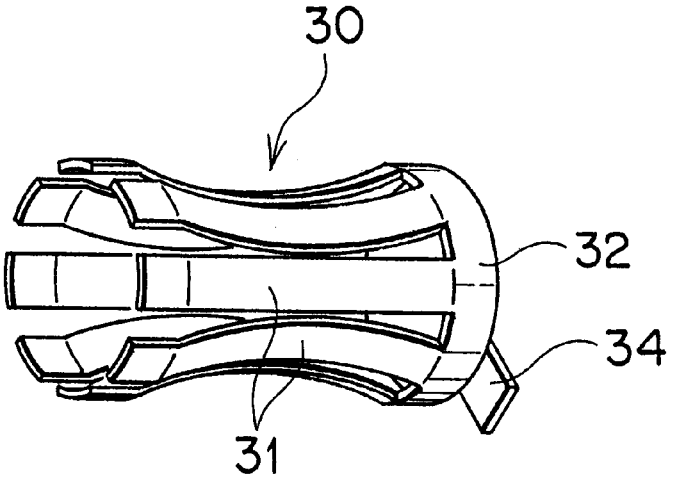
FIG. 3A and 3B are perspective views of modified contact spring members.
Figure 3B:
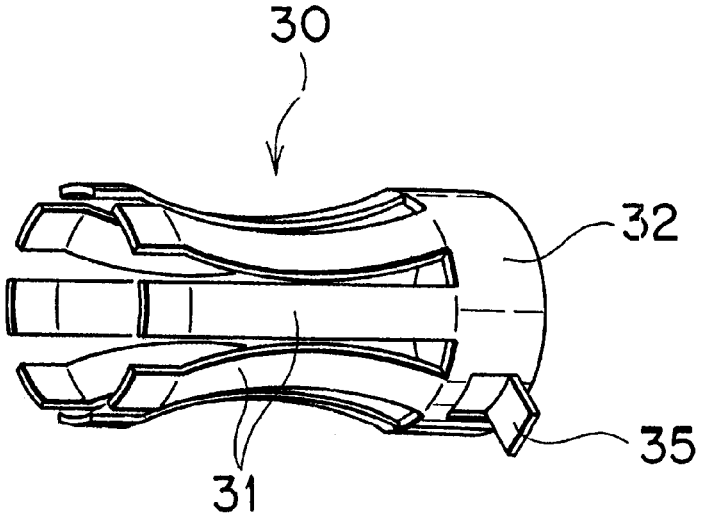

Alternatively, the fixing rib 33 of the contact spring member 30 may be replaced with a plurality of radially bent cut-pieces 34 or 35 as shown in FIG. 3A or 3B, respectively.

Contact spring members 30, on which the respective radially bent cut-pieces 34,35 are simply formed, can also be fixed easily to the female terminal 22.

In these structures, the larger number the radially bent cut-piece 34 or 35 is provided, the better stability of the contact spring member 30 is obtained. By increasing an abutting area of the radially bent cut-piece 34 or 35 against the inlet wall portion 22*d*, the contact spring member 30 can be fixed stable like the case of the annular fixing rib 33.

Figure 4:
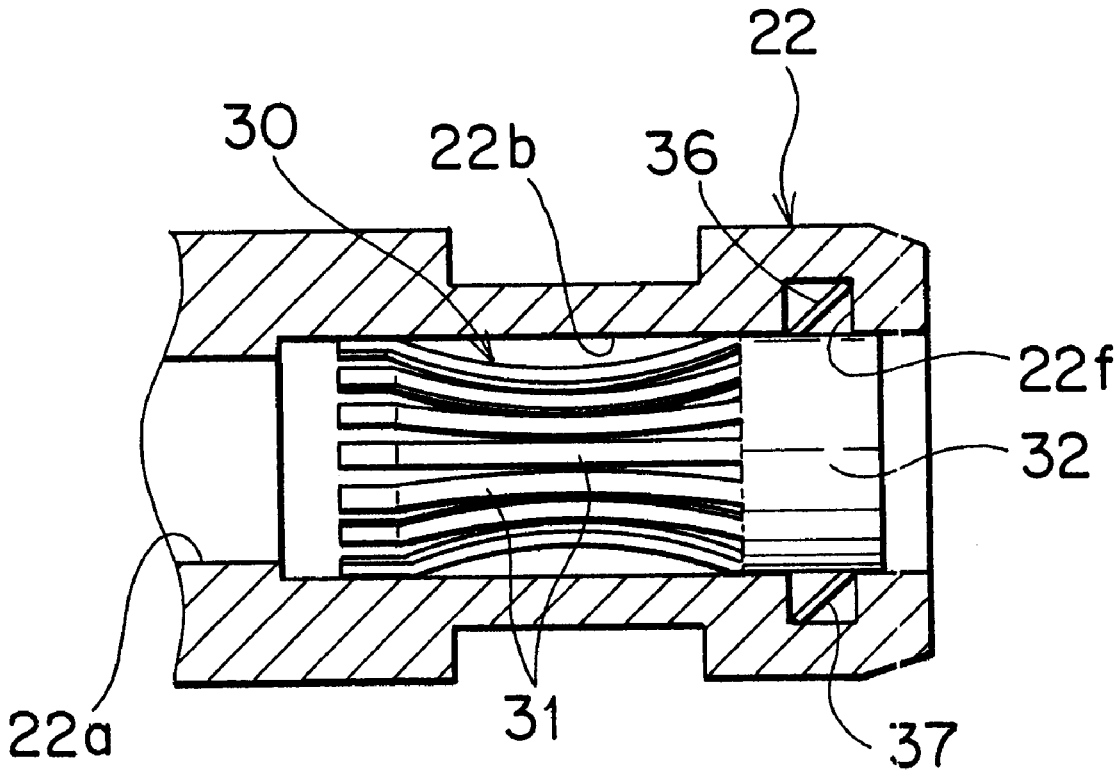
FIG. 4 is a partially longitudinal-sectional view showing a female terminal and a contact spring member of a second embodiment of a terminal for charging with large current in accordance with the present invention.

FIG. 4 shows a second embodiment of a terminal for charging with large current in accordance with the present invention.

Figure 7:
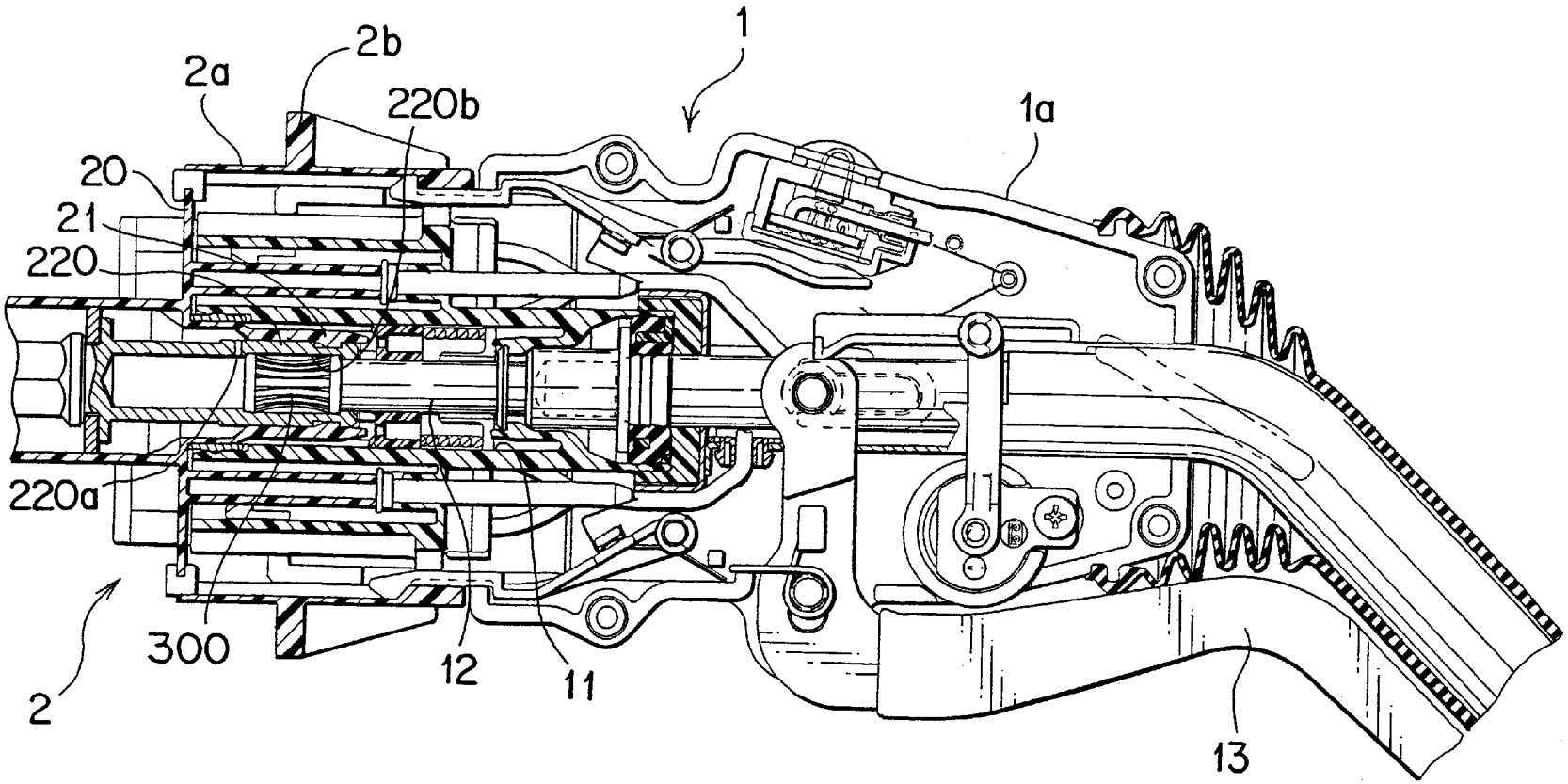
FIG. 7 PRIOR ART
FIG. 7 is a longitudinal-sectional view showing a state of connection of the feeding and fed side connectors of FIG. 6.
Figure 8A:
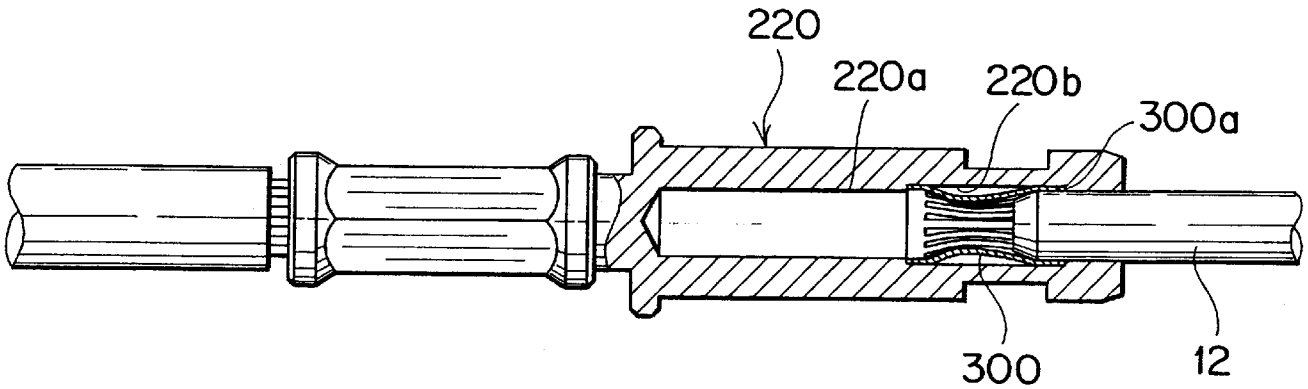
FIG. 8A PRIOR ART
FIG. 8A is a partially longitudinal-sectional view of the prior art terminal of FIG. 6.
Figure 8B:
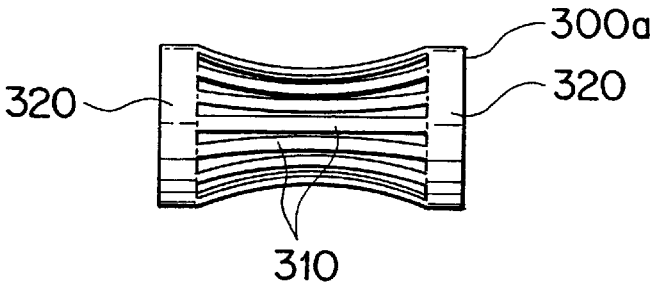
FIG. 8B PRIOR ART
FIG. 8B is an enlarged view of the contact spring member of FIG. 8A.

In this embodiment, referring to FIG. 4, an annular engaging recess 22*f* is formed near an inlet of a female terminal 22 and a pair of engaging pieces 36,37 engaging the engaging recess 22*f* of the female terminal 22 are formed on a connecting portion 32 of a contact spring member 30. The engaging pieces 36,37 incline oppositely to each other in an insertion or pulling-out direction of the male terminal 12 (FIG. 7).

According to the second embodiment, the structure can improve electrical contact between the female terminal 22 and a male terminal 12 by surely preventing unequal deformation of the leaf spring pieces 31 like the first embodiment of the terminal for charging with large current, while enabling to eliminate the cap 40 required in the first embodiment thereby fixing the contact spring member 30 in the large diameter portion 22*b* with easier structure.

And, movement of the contact spring member 30 along with an insertion or pulling-out of the male terminal 12 can be limited by the oppositely inclined engaging pieces 36,37, while easily and surely fixing the contact spring member 30 in the large diameter portion 22*b* of the female terminal 22.

Finally, FIG. 5 shows a third embodiment of a terminal for charging with large current in accordance with the present invention.

Figure 5A:
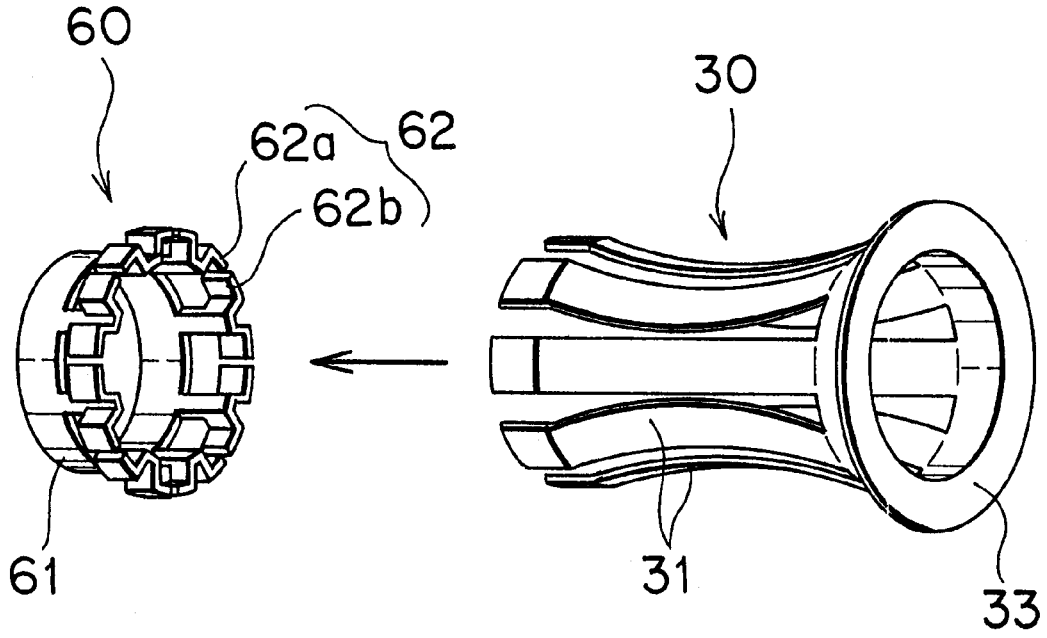
FIG. 5A is a perspective view showing a contact spring member and a holder of a third embodiment of a terminal for charging with large current in accordance with the present invention.

As shown in FIG. 5A, a terminal for charging with large current of this embodiment has structure of holding each of free ends of leaf spring pieces 31 of a contact spring member 30 by means of a holder 60.

The holder 60 is provided with an annular metal holder body 61 and spring receiving sections 62 each made up of a couple of symmetrically arranged L-shaped pieces 62*a*, 62*b* formed by cutting and bending the holder body 61.

Figure 5B:
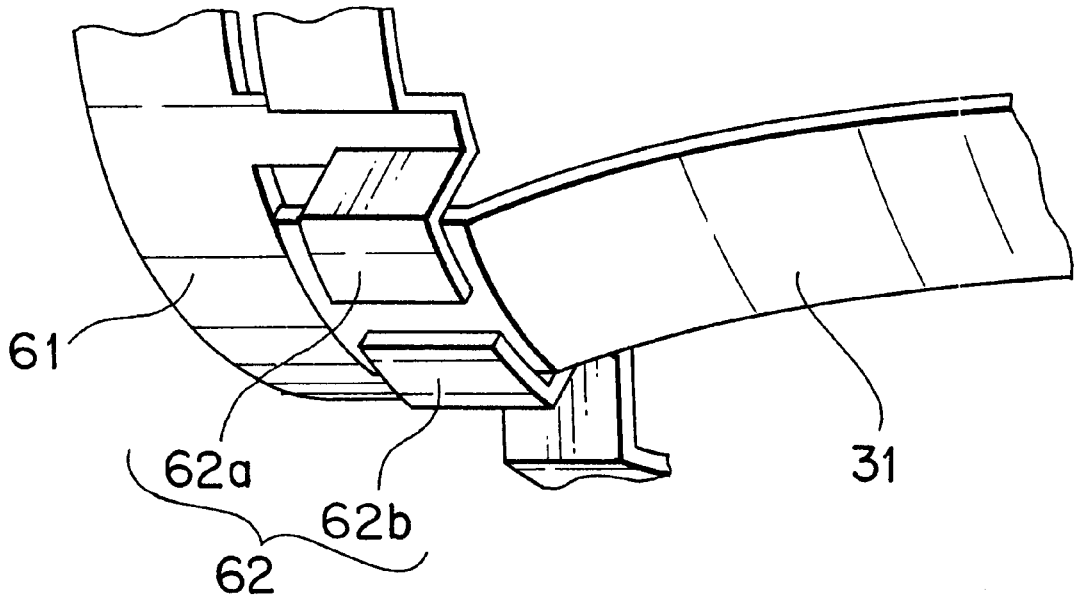
FIG. 5B is an enlarged perspective view showing a state of engagement between a leaf spring piece of the contact spring member and the holder of FIG. 5A.

As shown in FIG. 5B, the L-shaped pieces 62*a*,62*b* constituting the spring receiving section 62 abut on each side of the free end of the leaf spring piece 31 thereby limiting lateral deformation of the free end.

According to the third embodiment of the present invention, lateral deformation of the free ends of the leaf spring pieces 31 can be limited thereby preventing the leaf spring pieces 31 from laterally swinging when the male terminal 12 is inserted into the female terminal 22.

What is claimed is:

1. A terminal for charging with large current, comprising:

a female terminal having a terminal accommodating chamber to accommodate a rod-like male terminal, the terminal accommodating chamber having an inlet portion with a larger diameter formed at an inlet thereof;

a contact spring member consisting of a plurality of arced leaf spring pieces integrally linked at one side thereby to form a shape corresponding to an outer diameter of the male terminal and to an inner diameter of the terminal accommodating chamber of the female terminal, and having a fixing rib projecting in a radial direction from the one side integrally linked so as to abut the fixing rib on an inlet wall portion provided on an inner end of the inlet portion of the female terminal; and a cap having a terminal insertion hole to put the male terminal therethrough and attached to the inlet portion of the female terminal to hold the fixing rib of the contact spring member so as to fix the contact spring member in the terminal accommodating chamber of the female terminal;

wherein each of ends on the other side, being not integrally linked, of the leaf spring pieces of the contact spring member is capable of freely sliding on a surface of the terminal accommodating chamber in an axial direction thereof upon insertion or pulling-out of the male terminal so that each of the leaf spring pieces is in contact with an outer surface of the male terminal, thereby attaining secure electrical contact between the male terminal and the female terminal.

2. The terminal as claimed in claim 1, wherein the fixing rib of the contact spring member is annularly formed correspondingly to the inlet wall portion of the female terminal.

3. The terminal as claimed in claim 1, wherein the fixing rib of the contact spring member is formed in a shape partially corresponding to the inlet wall portion of the female terminal.

4. A terminal for changing with large current, comprising:

a female terminal having a terminal accommodating chamber to accommodate a rod-like male terminal, the terminal accommodating chamber having an engaging recess formed near an inlet thereof; and a contact spring member consisting of a plurality of arced leaf spring pieces integrally linked at one side thereby to form a shape corresponding to an outer diameter of the male terminal and to an inner diameter of the terminal accommodating chamber of the female terminal, and having a plurality of engaging pieces on the one side integrally linked so as to engage the engaging recess on the female terminal;

wherein each of ends on the other side, being not integrally linked, of the leaf spring pieces of the contact spring member is capable of freely sliding on a surface of the terminal accommodating chamber in an axial direction thereof upon insertion or pulling-out of the male terminal so that each of the leaf spring pieces is in contact with an outer surface of the male terminal, thereby attaining secure electrical contact between the male terminal and the female terminal.

5. The terminal as claimed in claim 4, wherein the engaging pieces of the contact spring member incline oppositely to each other in an insertion or pulling-out direction of the male terminal.

6. The terminal as claimed in claim 1, further comprising a holder for limiting circumferential movement of each of free ends of the leaf spring pieces of the contact spring member.

7. The terminal as claimed in claim 2, further comprising a holder for limiting circumferential movement of each of free ends of the leaf spring pieces of the contact spring member.

8. The terminal as claimed in claim 3, further comprising a holder for limiting circumferential movement of each of free ends of the leaf spring pieces of the contact spring member.

9. The terminal as claimed in claim 4, further comprising a holder for limiting circumferential movement of each of free ends of the leaf spring pieces of the contact spring member.

10. The terminal as claimed in claim 5, further comprising a holder for limiting circumferential movement of each of free ends of the leaf spring pieces of the contact spring member.

11. The terminal as claimed in any one of claim 1–10, further comprising a large diameter portion on an inlet side of the terminal accommodating chamber for fitting the contact spring member therein, the large diameter portion having a larger diameter than that of the terminal accommodating chamber and a length not restricting axial extension of the leaf spring pieces of the contact spring member in a state of the male terminal being inserted in the female terminal.

* * * * *